US006241112B1

(12) United States Patent
Claessens et al.

(10) Patent No.: US 6,241,112 B1
(45) **Date of Patent: *Jun. 5, 2001**

(54) STOPPER FOR SEALING INFUSION BOTTLES

(75) Inventors: Albert Louis Victor Jozef Claessens, Houthalen; Koen Louis Emma Van den Langenbergh, Wilrijk, both of (BE)

(73) Assignee: Helvoet Pharma Belgium N.V. (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/208,225

(22) Filed: Dec. 9, 1998

(30) Foreign Application Priority Data

Dec. 9, 1997 (DE) ..... 197 54 625

(51) Int. Cl.[7] ..... B65D 51/20
(52) U.S. Cl. ..... 215/247; 215/355; 215/DIG. 3
(58) Field of Search ..... 215/247, 249, 215/270, 355, DIG. 3; 604/403, 415

(56) References Cited

U.S. PATENT DOCUMENTS

| | | | | |
|---|---|---|---|---|
| 3,193,128 | * | 7/1965 | Ravn | 215/247 |
| 3,358,865 | * | 12/1967 | Andersen | 215/249 |
| 3,587,897 | * | 6/1971 | Rohde | 215/247 |
| 3,653,528 | * | 4/1972 | Wimmer | 215/247 |
| 4,244,478 | * | 1/1981 | Handman | 215/249 |
| 5,165,560 | * | 11/1992 | Ennis, III et al. | 215/247 |
| 5,588,547 | * | 12/1996 | Derksen | 215/247 |

FOREIGN PATENT DOCUMENTS

| | | | | |
|---|---|---|---|---|
| 2065925 | * | 10/1992 | (CA) | 215/355 |
| 1616183 | | 2/1968 | (DE) . | |
| 2041740 | | 8/1970 | (DE) . | |
| 3241283 CS | | 11/1982 | (DE) . | |
| 3638928 | * | 5/1988 | (DE) | 215/355 |
| 4135470A1 | | 10/1991 | (DE) . | |
| 4228090CS | | 8/1992 | (DE) . | |
| 4344134 A1 | | 12/1993 | (DE) . | |
| 0680889A1 | | 4/1995 | (EP) . | |
| 1282024 | * | 3/1962 | (FR) | 215/270 |
| WO-88/06556 | * | 9/1988 | (WO) . | |
| 94/15850 | * | 7/1994 | (WO) | 215/247 |

* cited by examiner

*Primary Examiner*—Nathan J. Newhouse
(74) *Attorney, Agent, or Firm*—Eugene E. Renz, Jr., PC

(57) ABSTRACT

A stopper for sealing containers for pharmaceutical liquids, especially infusion bottles, which stopper has a collar, which projects into the neck of the container; an edge, which rests on the neck of the container; and a puncture area, enclosed by the edge and the collar, the stopper being held on the neck of the container by a protective cap of metal or plastic, characterized in that the puncture area (3) is designed to have such elasticity and flexibility with respect to the edge (9) and the collar (6) that, after the stopper has been inserted into the neck (4) of the container, the puncture area bulges slightly outward; and in that, after the puncture needle (15) of an infusion kit (16) has been inserted into the stopper, the puncture area bulges down into the neck (4) of the container.

2 Claims, 3 Drawing Sheets

STOPPER FOR SEALING INFUSION BOTTLES

FIELD OF THE INVENTION

The present invention relates to a stopper for sealing containers holding pharmaceutical liquids, especially to a stopper for infusion bottles, which stop per has a collar, which projects into the neck of the container; an edge, which rests on the neck of the container; and a puncture area, which is enclosed by the edge and the collar, the stopper being held on the neck of the container by a protective cap made out of metal or plastic.

BACKGROUND OF THE INVENTION

Stoppers of this type to which the present invention relates is for infusion bottles are described in, for example, DE 3,241,283 C3, DE 4,135,470 A1, DE 4,228,090 C2, and DE 4,344,134 A1. All of them have a collar which is very long in comparison to the edge and also to the thickness $H_1$ of the puncture area, with the result that the collar projects quite far into the neck of the bottle. In addition, the top surface of the puncture area is uniform in height and is level with the edge of the stopper. In these known stoppers for infusion bottles, the puncture area is relatively thick; this is done to prevent the puncture needle of the infusion kit from sliding out of the stopper under its own weight and the weight of the infusion liquid present in it, in the drip chamber, and in the tubing connected to the needle after the infusion bottle has been hung upside down. In this context, reference can be made to the standards DIN 38,363 and ISO 8,536.2, which pertain to these types of sealing stoppers, also called "hollow stoppers". In the test of the strength with which the puncture needle is held in the stopper according to the DIN standard, the test needle may not slide out of the stopper for 5 hours under an additional load of 0.5 kg. To ensure, therefore, that a sufficient amount of lateral pressure can be exerted on the inserted needle and to increase the friction between the surface of the needle and the surface of the hole formed in the puncture area of the stopper by the puncture, the puncture area of stoppers of this type is made quite thick, so that it is held relatively rigidly between the edge and the collar. The disadvantage of this stopper is that a relatively large amount of force is required to push the relatively thick puncture needle of an infusion kit through it. In this regard, furthermore, the above-cited standards, especially the DIN standard, specify that, in the test of the puncturability of the stopper, the force required to push the needle through the stopper may not exceed 100 N.

Against the background of these known stoppers for infusion bottles, it is therefore the goal of the present invention to design a stopper of the general type in question in such a way that much less effort is required to push the puncture needle of an infusion kit through the stopper, which means that, even though the puncture area of the stopper is much thinner, the infusion kit is nevertheless securely held by the stopper on the upside-down infusion bottle and thus prevented from sliding out.

SUMMARY OF THE INVENTION

This goal is achieved with a stopper of the type described above in that the puncture area is designed with such elasticity and flexibility with respect to the edge and the collar that it bulges slightly outward after the stopper has been inserted into the neck of the container, whereas, after the puncture needle has been pushed through the stopper, the puncture area bulges down into the neck of the container.

This flexible design of the puncture area of the stopper means that, after the stopper has been inserted into the neck of the container, it is under a state of tension because of its outward bulge; the collar thus exerts pressure on the inside surface of the container neck. This results in a sealing action on the neck, which remains in effect even after the infusion bottle has been hung upside down. As soon as the puncture needle is pushed through the puncture area in the stopper, however, the outward bulge of the puncture area is changed into an inward bulge, directed down into the interior of the container. Thus, as a result of the thickening of the material caused by the insertion of the puncture needle, the strength with which the collar adheres to the inside surface of the container neck is increased even more. The inward bulge of the punctured puncture area downward into the interior of the container reinforces the holding action on the puncture needle when the infusion bottle is placed upside down. From the viewpoint of statics, the puncture area of the stopper is supported like an arch between the outside surface of the puncture needle at one end and the collar or inside surface of the container neck at the other, and the weight of the infusion kit merely increases these forces.

To give the stopper according to the invention this property of flexibility, the top surface of the puncture area is made lower than the top surface of the edge. Because the puncture area is intentionally made lower than the edge, it acquires the previously described ability to bulge inward and outward.

Another factor which contributes to this ability is that the bottom surface of the stopper inside the collar is relatively flat and essentially parallel to the surface of the puncture area. This design of the puncture area of the stopper provides the flexibility required for the proper action of the stopper in its function as a seal for infusion bottles in conjunction with an infusion kit.

This flexibility of the stopper is also promoted by the fact that the length of the collar projecting downward beyond the bottom surface of the puncture area is almost the same as the thickness of the puncture area. By making the collar smaller that the collars of conventional stoppers, it is possible for the force acting on the stopper by virtue of the flexibility and elasticity of the puncture area of the stopper to act more effectively on the collar, and, even though the contact area of the collar against the inside surface of the container neck is smaller than that of conventional stoppers, it can nevertheless provide the necessary sealing and retaining functions.

It has been found that the stopper according to the invention, because of its design as described above and the properties attributable to that design, is able to offer not only the advantages presented above but also the advantage of much smaller dimensions than those of conventional stoppers for infusion bottles. As a result, the amount of material required to produce such stoppers is decreased, which has advantageous effects on production, since the stopper is, after all, a mass-produced item.

BRIEF DESCRIPTION OF THE DRAWINGS

These and other objects of the present invention and various features and details of the operation and construction thereof are hereinafter more fully set forth with reference to the accompanying drawings, wherein.

DETAILED DESCRIPTION OF THE PREFERRED EMBODIMENT

Figure 1:
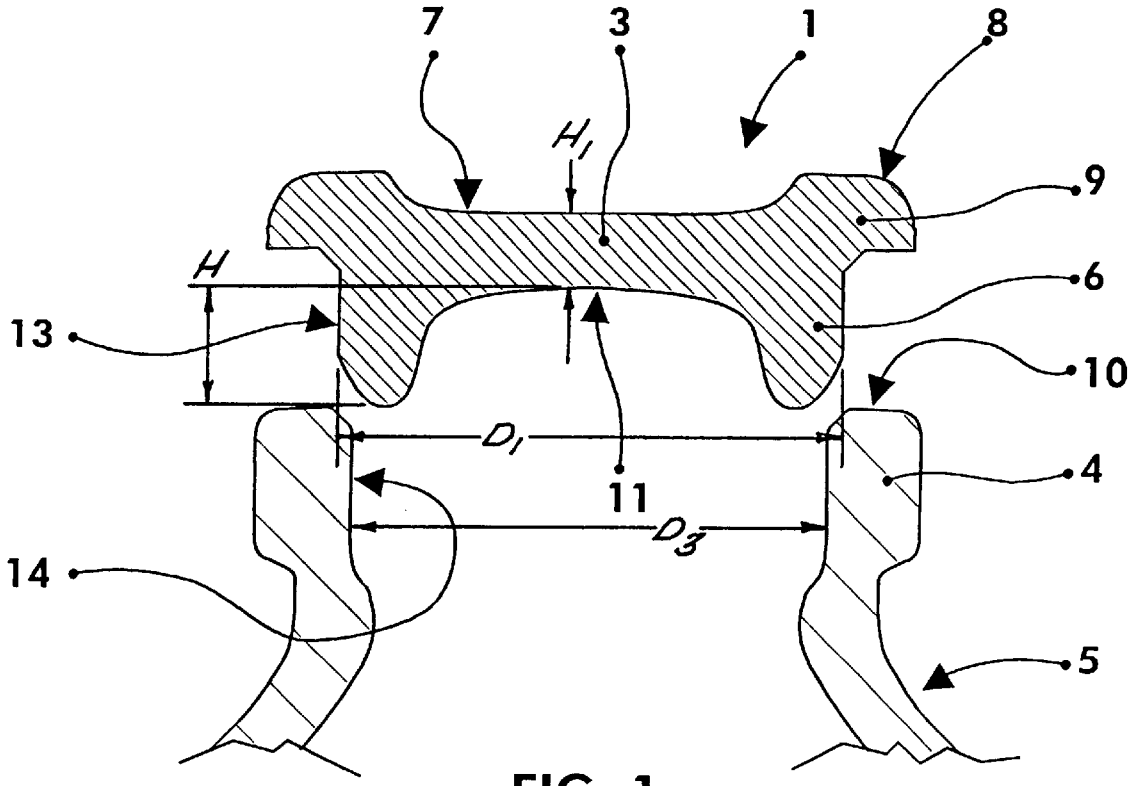
FIG. 1 shows a cross section through a stopper according to the invention and a container neck provided to receive the stopper before the stopper has been inserted into the container.
Figure 3:
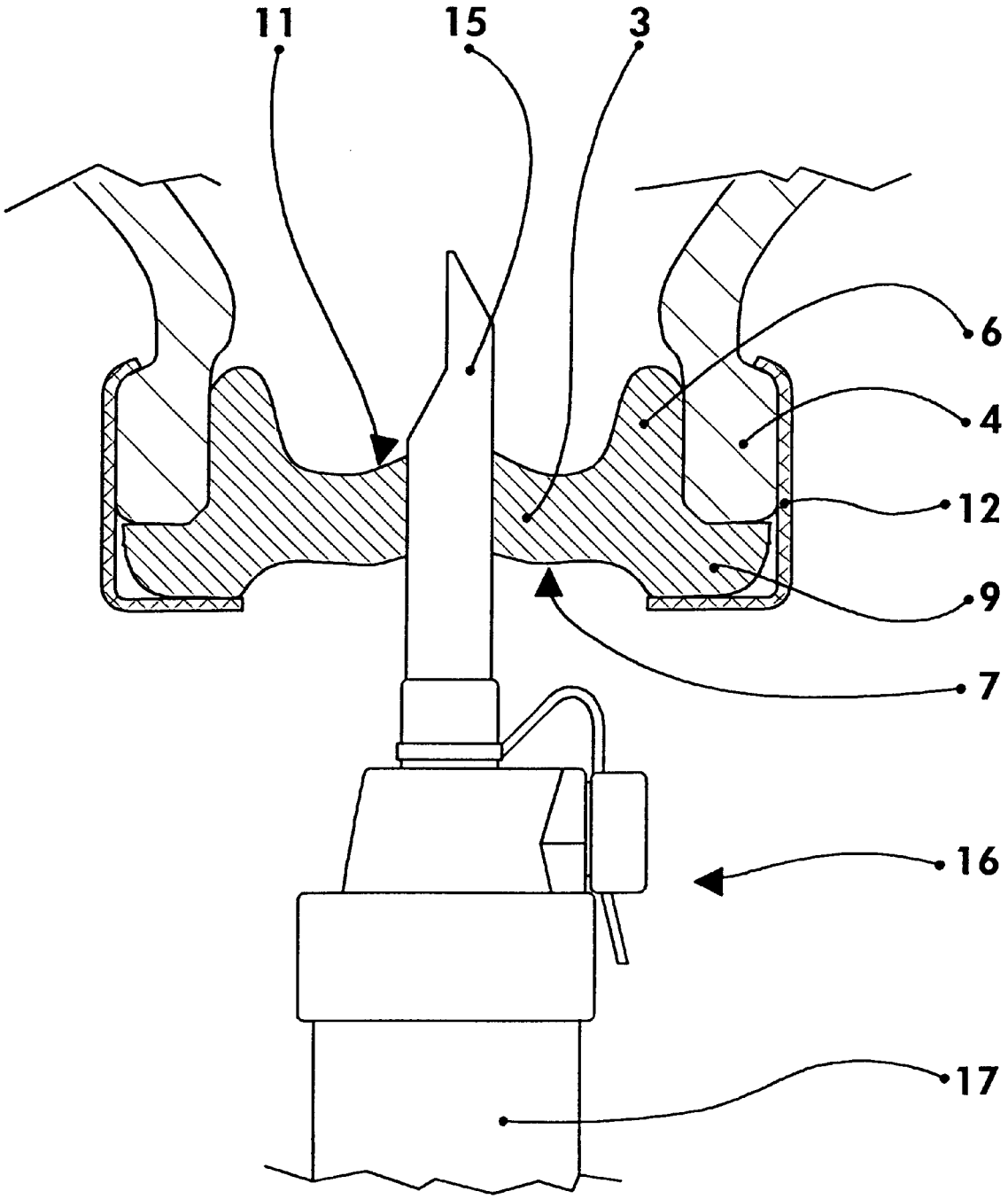
FIG. 3 shows a cross section through a stopper after it has been punctured by the puncture needle of an infusion kit and after the infusion bottle has been placed upside down.
Figure 4:
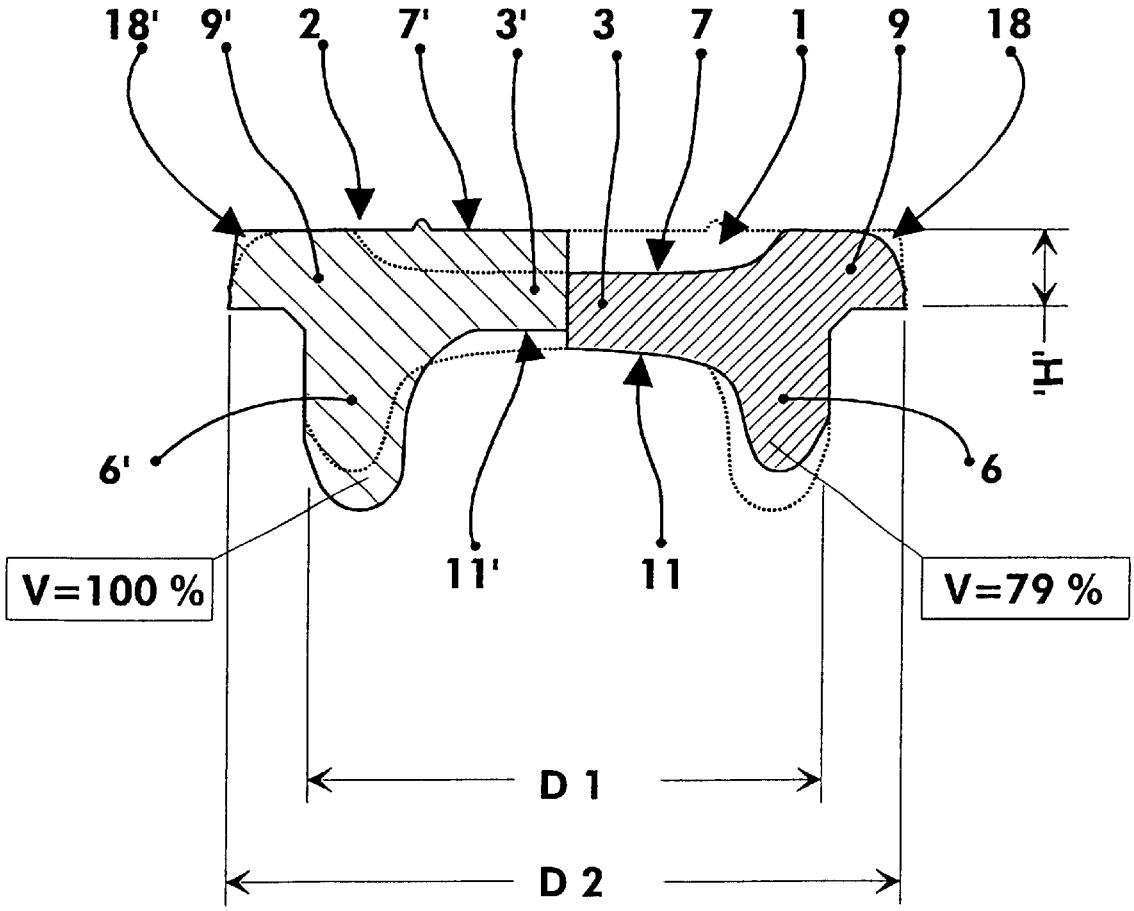
FIG. 4 shows a cross-sectional comparison of a stopper according to the invention with a conventional stopper.

Referring now to the drawings and particularly FIG. 1 thereof, the stopper (1) shown in the figures is distinguished from a conventional stopper (2) shown in FIG. 4 in cross section by the special design of its puncture area (3) and its collar (6), which projects into neck (4) of container (5). Thus, top surface (7) of puncture area (3) is lower than top surface (8) of its edge (9), with the result that, as a whole, puncture area (3) of stopper (1) is situated in a lower position; in particular, the center of its thickness is approximately under, with advantage just slightly under, the plane formed by end surface (10) of container neck (4). It follows from this that bottom surface (11) of the puncture area of the stopper is also lower down in the interior space of container relatively flat, i.e., designed with only a slight degree of curvature, with the result that puncture area (3) of stopper (1) is more flexible with respect to edge (9) and collar (6) than is true for conventional stoppers and therefore is able to deform with respect to edge (9) and collar (6), as shown in FIGS. 2 and 3.

In the preferred embodiment of the invention, the length or height (H) of the collar (6) projecting downwardly beyond the bottom surface (11) of the puncture area (3) is generally the same or equal to the thickness of the puncture area (3). Further, the outer diameter ($D_1$) of the collar (6) in the relaxed state is preferably greater than the diameter ($D_3$) of the inside surface (14) of the neck (4) of the bottle to deflect the top and bottom surfaces (7) and (11) of the puncture area as shown in FIG. 2.

Figure 2:
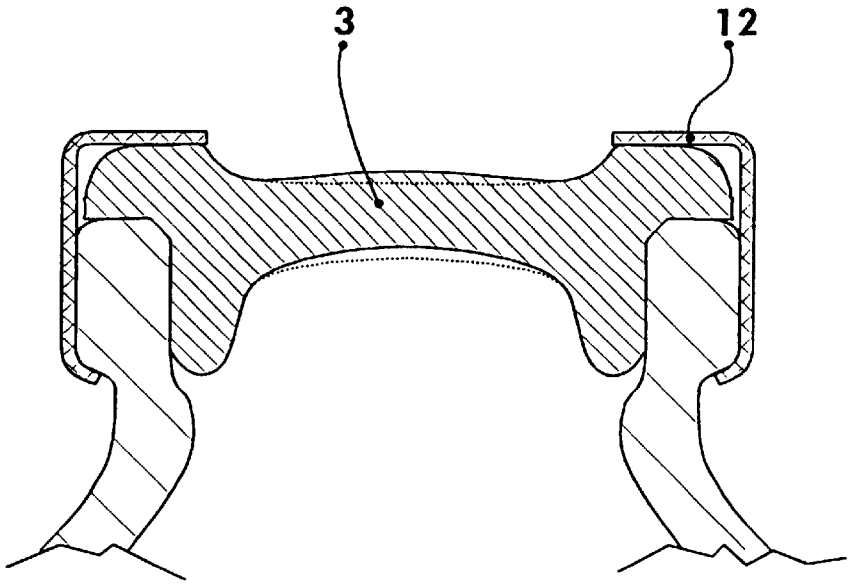
FIG. 2 shows a cross section through the container neck after the stopper has been inserted and after a cap has been put on to retain the stopper on the container neck.

It is evident from FIG. 2 that stopper (1), after it has been inserted by its collar (6) into neck (4) of container (5) and is resting by its edge (9) on end surface (10) of container neck (4) and is retained by a cap (12) made of plastic or metal, bulges slightly outward in its puncture area (3) because of its flexibility, as a result of which the pressure applied by outside surface (13) of collar (6) against inside surface (14) of container neck (4) is increased and a better seal is produced between stopper (1) and neck (4) of the bottle. This seal is essential for infusion bottles in particular, which are held upside down during use.

The outward bulge of puncture area (3) of stopper (1) reverses direction when, as shown in FIG. 3, puncture needle (15) of an infusion kit (16) with drop chamber (17) and a tube (not shown) is pushed into stopper (1). This is because puncture area (3) experiences compression as a result of its displacement in space by puncture needle (15) of infusion system (16), and puncture area (3) thus gives way. In terms of the static forces involved, puncture area (3) supported like an arch between puncture needle (15) at one end and collar (6) at the other, and thus the more forcefully it is pulled downward by its own weight and the weight of infusion system (16) and the liquid present in it, the more tightly it grips puncture needle (15).

In comparison with conventional stoppers, e.g., those which are thicker and more rigid, the stopper according to the invention offers greater reliability in spite of the intentional decrease in the amount of material used. It also offers the advantage that puncture needle (15) can be pushed through puncture area (3) of stopper (1) with less effort.

A side benefit effect not to be underestimated is achieved by stopper (1) according to the invention in comparison with conventional stoppers (2) in that the amount of plastic material required to produce this new stopper is more than 20% less. Reference can be made in this regard to FIG. 4, in which a conventional stopper (2) is compared with stopper (1) according to the invention. The two stoppers have identical dimensions ($D_1$, $D_2$, and H). FIG. 4 illustrates in particular that top surface (7) is lower than top surface (7') of a conventional stopper (2). Stopper (1) according to the invention, as illustrated in FIG. 4, has a volume of 4,225 mm, whereas conventional stopper (2) has a volume of 5,330 mm. That is, stopper (1) according to the invention can produced with only 79% of the material required for conventional stopper (2).

In addition, it is true not only that top surface (7) is situated lower down but also that collar (6) is narrower than a conventional stopper (2) and can be produced out of less material. In spite of this, the sealing and retaining properties known from conventional stoppers (2) are preserved, as described above, but in addition, because of the special flexible design of stopper (1) according to the invention, these sealing and retaining properties are even more effective.

Another reduction in the amount of material is achieved in that corner (18) of edge (9) of stopper (1) according to the invention is rounded to a much greater degree than corner (18') of edge (9') of conventional stopper (2). This rounding of corner (18) in stopper (1) according to the invention also has the effect of improving the handling of this stopper when the containers are sealed by machine.

Even though a particular embodiment of the invention has been illustrated and described herein, it is not intended to limit the invention and changes and modifications may be made therein within the scope of the following claims.

What is claimed is:

1. A stopper for sealing infusion bottles containing pharmaceutical liquids, which stopper has a collar, which projects into the opening in the neck of the container and has a diameter greater than the neck opening; an edge, which rests on the neck of the container; and a puncture area, enclosed by the edge and the collar, the stopper being held on the neck of the container by a protective cap of metal or plastic, characterized in that the top surface (7) of the puncture area (3) is lower than the top surface (8) of the edge (9), and in that the bottom surface (11) of the stopper (1) inside the collar (6) as well as the top surface (7) of the puncture area (3) are relatively flat, and in that a transverse plane formed by end surface (10) of container neck (4) passes through approximately the center of the vertical thickness of the puncture area, and wherein the length of said collar is generally the same as the cross sectional thickness of the puncture area, the puncture area (3) having a predetermined elasticity and flexibility with respect to the edge (9) and the collar (6) whereby after the stopper has been inserted into the neck (4) of container, the puncture area bulges slightly outward and remains in that position until the puncture needle (15) of an infusion kit (16) has been inserted into the stopper (1), and in that the puncture area bulges down into neck (4) of the container when being pierced by the puncture needle (15) and remains in this position as long as the puncture needle (15) is inserted into the stopper.

2. A stopper according to claim 1, characterized in that the corner (18) of the edge (9) of the stopper (1) is rounded.

* * * * *